US007069824B2

(12) United States Patent
Fitzpatrick

(10) Patent No.: US 7,069,824 B2
(45) Date of Patent: Jul. 4, 2006

(54) LEVERAGE HANDLE

(75) Inventor: John P. Fitzpatrick, Royal Oak, MI (US)

(73) Assignee: Snap Jaws Manufacturing, Troy, MI (US)

( * ) Notice: Subject to any disclaimer, the term of this patent is extended or adjusted under 35 U.S.C. 154(b) by 389 days.

(21) Appl. No.: 10/823,889

(22) Filed: Apr. 14, 2004

(65) Prior Publication Data

US 2006/0075855 A1 Apr. 13, 2006

(51) Int. Cl.
*B25B 23/16* (2006.01)

(52) U.S. Cl. ..... 81/177.2; 81/176.15; 81/180.1

(58) Field of Classification Search ..... 81/177.2, 81/176.15, 180.1, 177.5, 124.5, 124.6, 124.7, 81/177.7

See application file for complete search history.

(56) References Cited

U.S. PATENT DOCUMENTS 556,151 A * 3/1896 Johnson ..... 81/58.2
776,761 A * 12/1904 Sampson ..... 81/177.8
923,420 A * 6/1909 Drake ..... 81/120
968,106 A * 8/1910 Zimmermann ..... 81/120
1,193,326 A * 8/1916 Westcott ..... 81/179
2,715,347 A * 8/1955 Johnson ..... 81/124.2
3,787,948 A * 1/1974 Runge ..... 81/121.1
D243,820 S 3/1977 Hickman
4,899,999 A 2/1990 Arnold
5,669,404 A * 9/1997 Guillermo ..... 137/315.12
5,683,077 A 11/1997 Fink et al.
5,737,981 A * 4/1998 Hildebrand ..... 81/53.2
D435,765 S * 1/2001 Owens et al. ..... D8/28
6,361,442 B1 3/2002 Dillenberger et al.

* cited by examiner

*Primary Examiner*—Lee D. Wilson
*Assistant Examiner*—Alvin J. Grant
(74) *Attorney, Agent, or Firm*—Carlson, Gaskey & Olds

(57) ABSTRACT

A leverage handle tool includes a handle and a seat block. In use, a slot in the seat block is located upon a handle such as a vice handle, and the tool is pulled toward the handle end. As the tool is pulled toward the handle end the slot grips the handle due to the frusto-conical configuration thereof. The tool may then be acted upon such that the tool increase the leverage upon handle.

8 Claims, 2 Drawing Sheets

LEVERAGE HANDLE

BACKGROUND OF THE INVENTION

The present invention relates to a hand tool, and more particularly to a leverage increasing hand tool for a vice.

Vices are long known for holding work pieces during shaping, cutting, finishing, and the like. Other vice jaws are incorporated into machine tools to receive a workpiece. The vice typically utilizes an extended handle, which is rotated to close the vice and retain the workpiece. Oftentimes, it is difficult to manually achieve significant leverage on the vice handle to exert the desired vice jaw force. Machinists and others have often utilized a section of pipe to increase the leverage on the vice handle. This may be relatively difficult when the vice handle includes a knobbed end. Furthermore, the section of pipe may readily disengage from the vice handle.

Accordingly, it is desirable to provide a hand tool which increases the leverage that is exerted upon a vice handle in an efficient and safe manner.

SUMMARY OF THE INVENTION

The leverage handle tool according to the present invention provides a handle and a seat block. The seat block defines a frusto-conical slot along a slot axis parallel and offset from a handle axis.

In use, the slot is located upon a handle such as a vice handle, and the tool is pulled toward the handle end. As the tool is pulled toward the handle end, the slot grips the handle due to the frusto-conical configuration thereof. The tool may then be acted upon such that the tool increase the leverage upon the vice handle.

The present invention therefore provides a hand tool which increases the leverage exerted upon a vice handle in an efficient and safe manner.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
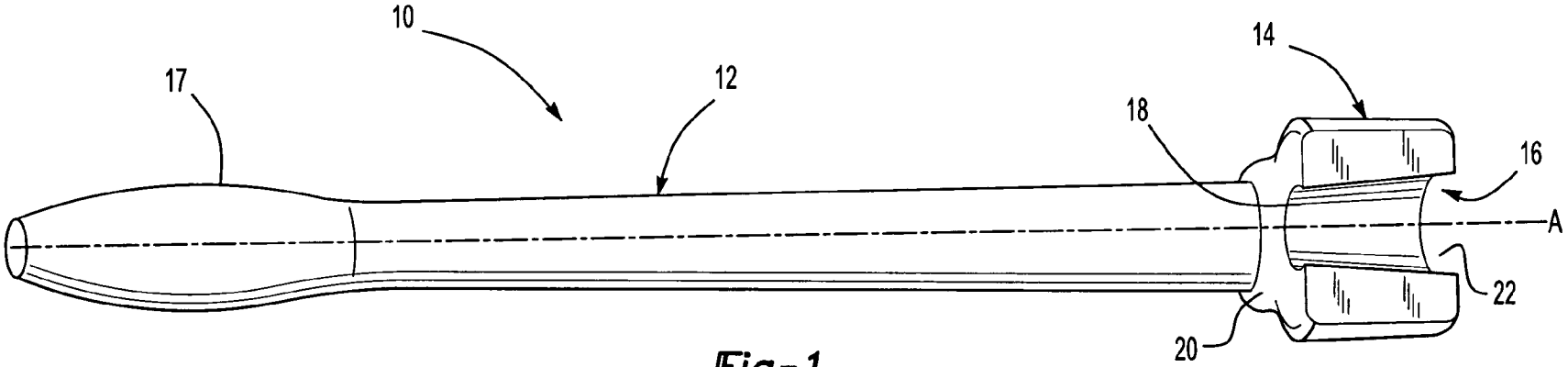
FIG. 1 is a general perspective view of a hand tool.
Figure 2:
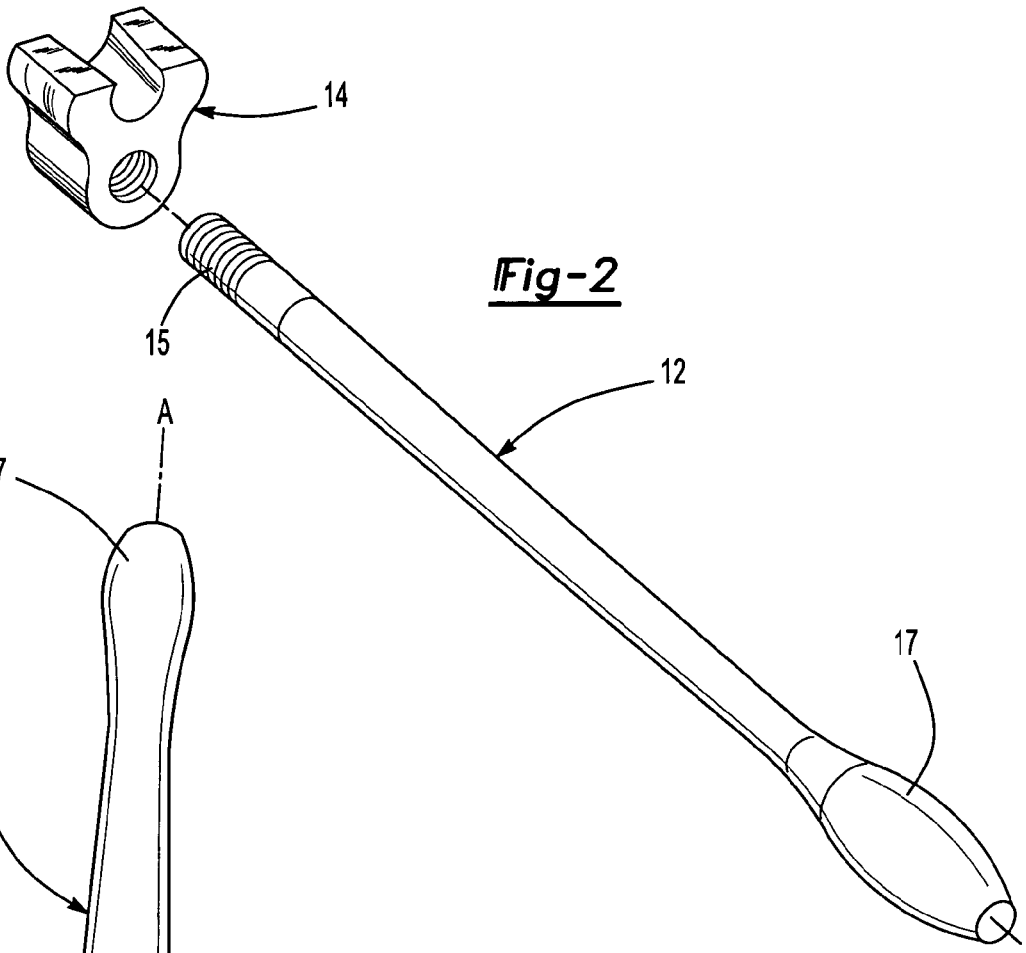
FIG. 2 is a general perspective view of a hand tool.

FIG. 1 illustrates a general perspective view of a leverage handle tool 10. The tool 10 generally includes a handle 12 and a seat block 14. The seat block 14 is mounted to an end section 15 of the handle 12 through, threads, welding or the like (FIG. 2).

The handle 12 defines a first axis A. The handle 12 includes an enlarged end 17 located opposite the block 14. The handle 12 may alternatively or additionally include a non-slip surface, grip or the like.

Figure 3:
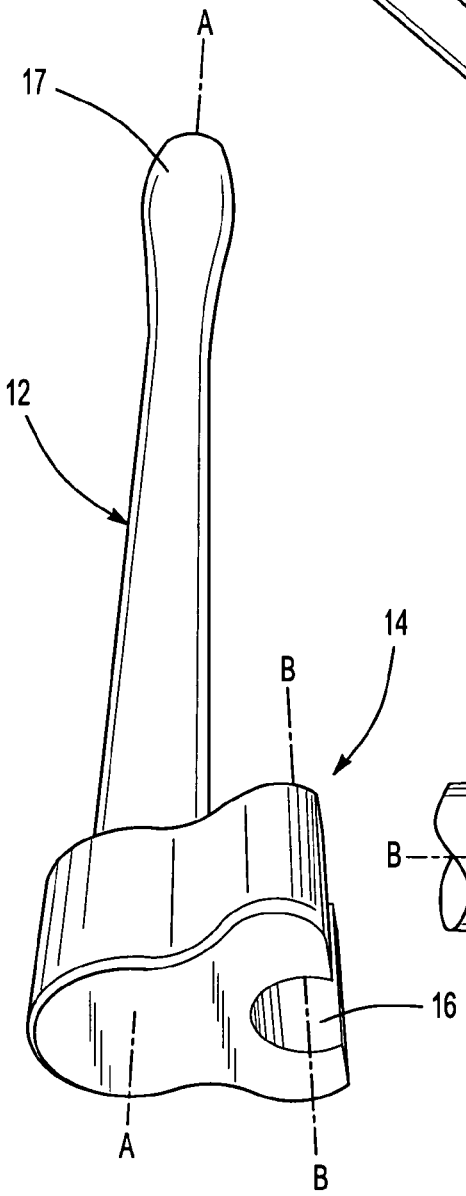
FIG. 3 is a general perspective view of a hand tool.
Figure 4:
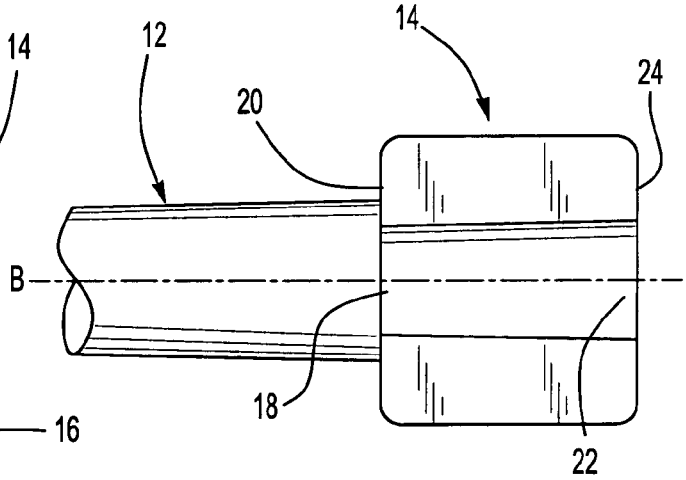
FIG. 4 is a general perspective view of a hand tool.

The seat block 14 preferably defines a frusto-conical slot 16 along a slot axis B (FIG. 3). That is, the slot 16 defines a relatively smaller semi-circular opening 18 at a handle end 20 and a relatively larger semi-circular opening 22 at an opposite end 24 of the seat block 14 (FIG. 4). The slot axis B is defined parallel and offset from axis A.

Figure 5:
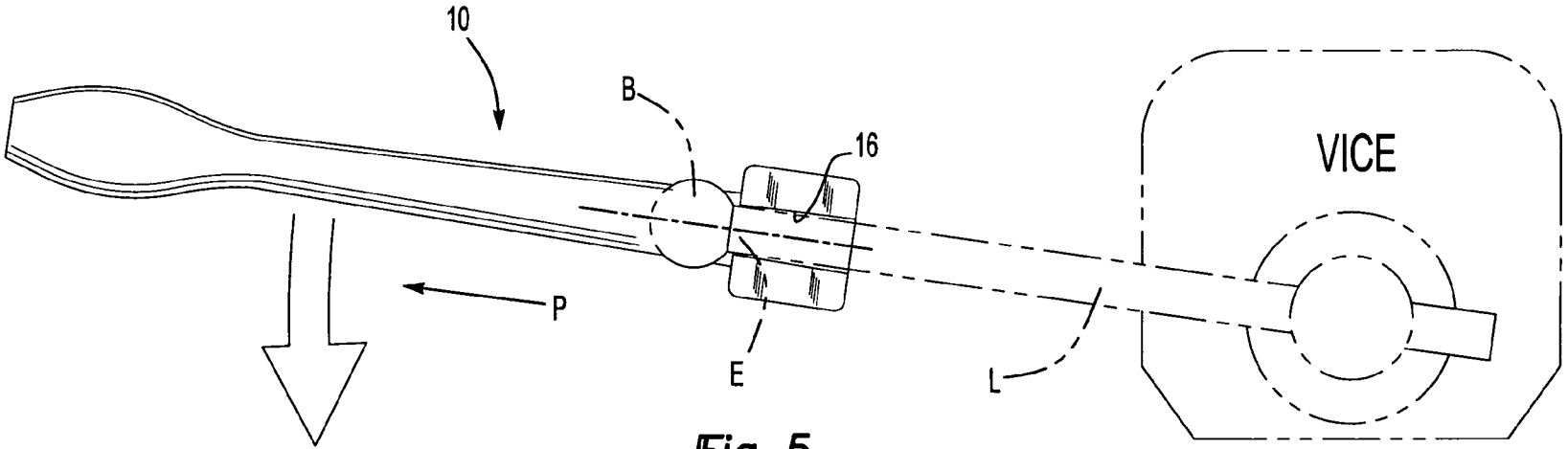
FIG. 5 is a general perspective view of a hand tool mounted to a vice handle for use.

Referring to FIG. 5, the tool 10 is mounted for use. Generally, the slot 16 is located upon a handle L, such as a vice handle, and the tool 10 is pulled toward the handle end E (indicated by arrow P). As the tool 10 is pulled toward the handle end E, the slot 16 grips the handle L due to the frusto-conical configuration thereof. As the axes A, B are offset, the handle 12 will clear a ball B or the like on the end of the handle L. The tool 10 may then be acted upon such that the tool 10 increases the leverage upon handle L. It should be understood that the tool 10 may be utilized on various handles, machines, vices and the like.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

The invention claimed is:

1. A hand tool comprising:

a handle extending along a first axis; and a seat block mounted to an end of said handle, said seat block having an outwardly opening slot with an open face, said slot being centered around a second axis that is generally parallel but offset from said first axis, and said open face of said slot being configured to be movable downwardly onto a shaft of a vice, and to be moved along the shaft until said seat block abuts an enlarged portion on the shaft, such that said handle can then be utilized to apply torque to said shaft with an elongated lever arm due to the attachment of said handle to the shaft.

2. The hand tool as recited in claim 1, wherein said slot has a first cross-section at a first end remote from said handle and a second cross-section at a second end spaced toward said handle, with said second cross-section being smaller than said first cross section.

3. The hand tool as recited in claim 2, wherein said slot is generally frusto-conical between said first and second ends.

4. A combination of a vice and a handle comprising:

a vice having a shaft extending along an axis to an enlarged portion;

a hand tool received to create an elongated lever arm to allow increased torque to turn said shaft, said hand tool comprising a handle extending along a first axis, and a seat block mounted to an end of said handle, said seat block having an outwardly opening slot with an open face, and said open face of said slot being configured to be movable downwardly onto the shaft, and to be moved along the shaft until said seat block abuts the enlarged portion on the shaft, such that said handle can then be utilized to apply torque to the shaft with an elongated lever arm due to the attachment of said handle to the shaft.

5. The combination as recited in claim 4, wherein said slot has a first cross-section at a fist end remote from said handle and a second cross-section at a second end spaced toward said handle, with said second cross-section being smaller than said first cross section.

6. The combination as recited in claim 5, wherein said slot is generally frusto-conical between said first and second ends.

7. The combination as recited in claim 4, wherein said slot is centered around a second axis that is generally parallel but offset from said first axis.

8. A method of increasing leverage on a vice handle comprising the steps of:

(1) providing a vice shaft extending to an enlarged portion;

(2) moving a hand tool onto said vice shaft such that an open slot in a seat block is moved onto said vice shaft, and said open slot is then brought to abut said enlarged portion of said vice shaft with a tool handle extending from said seat block, and beyond said enlarged portion;

(3) applying a torque to said tool handle, such that said torque is transferred to said vice shaft through said slot.

* * * * *

UNITED STATES PATENT AND TRADEMARK OFFICE

CERTIFICATE OF CORRECTION

PATENT NO. : 7,069,824 B2
APPLICATION NO. : 10/823889
DATED : July 4, 2006
INVENTOR(S) : John P. Fitzpatrick It is certified that error appears in the above-identified patent and that said Letters Patent is hereby corrected as shown below:

Claim 5, Column 2, line 67: "fist" should be --first--

Signed and Sealed this

Seventh Day of November, 2006

JON W. DUDAS
*Director of the United States Patent and Trademark Office*